US010087769B2

(12) United States Patent
Dungs et al.

(10) Patent No.: US 10,087,769 B2
(45) Date of Patent: Oct. 2, 2018

(54) SEALING SYSTEM AND GAS TURBINE

(71) Applicant: Siemens Aktiengesellschaft, Munich (DE)

(72) Inventors: Sascha Dungs, Wesel (DE); Karsten Kolk, Mülheim a.d. Ruhr (DE); Peter Schröder, Essen (DE)

(73) Assignee: Siemens Aktiengesellschaft, Munich (DE)

( * ) Notice: Subject to any disclaimer, the term of this patent is extended or adjusted under 35 U.S.C. 154(b) by 322 days.

(21) Appl. No.: 15/035,400

(22) PCT Filed: Oct. 24, 2014

(86) PCT No.: PCT/EP2014/072817
§ 371 (c)(1),
(2) Date: May 9, 2016

(87) PCT Pub. No.: WO2015/071070
PCT Pub. Date: May 21, 2015

(65) Prior Publication Data

US 2016/0265378 A1 Sep. 15, 2016

(30) Foreign Application Priority Data

Nov. 18, 2013 (EP) ..... 13193327

(51) Int. Cl.

| | |
|---|---|
| ***F01D 5/30*** | (2006.01) |
| ***F01D 11/00*** | (2006.01) |
| ***F01D 5/02*** | (2006.01) |
| ***F01D 5/12*** | (2006.01) |
| ***F01D 5/32*** | (2006.01) |

(52) U.S. Cl.
CPC ..... *F01D 11/006* (2013.01); *F01D 5/02* (2013.01); *F01D 5/12* (2013.01); *F01D 5/3007* (2013.01); *F01D 5/3015* (2013.01); *F01D 5/326* (2013.01); *F05D 2220/32* (2013.01); *F05D 2260/30* (2013.01)

(58) Field of Classification Search
CPC ..... F01D 5/30; F01D 5/3007; F01D 5/326; F01D 5/3069; F01D 5/3015
See application file for complete search history.

(56) References Cited

U.S. PATENT DOCUMENTS 2,971,744 A 2/1961 Szydlowski
3,656,865 A 4/1972 Spears, Jr.
(Continued)

FOREIGN PATENT DOCUMENTS

EP 1840338 A1 * 10/2007 ..... F01D 5/3015
EP 1944471 A1 7/2008
(Continued)

OTHER PUBLICATIONS

CN Office Action dated Oct. 24, 2016, for CN patent application No. 201480062779.8.

*Primary Examiner* — Richard Edgar
(74) *Attorney, Agent, or Firm* — Beusse Wolter Sanks & Maire

(57) ABSTRACT

A sealing system includes a bolt and a cover plate for sealing a joint between a rotor disk and a blade root of a rotor blade, the blade root being disposed in a blade root slot in the rotor disk. The sealing arrangement is used in particular in a gas turbine.

6 Claims, 4 Drawing Sheets

(56) References Cited

U.S. PATENT DOCUMENTS

| | | | |
|---|---|---|---|
| 3,887,298 | A | 6/1975 | Hess et al. |
| 2008/0181768 | A1 | 7/2008 | Bruecher et al. |
| 2009/0116965 | A1 | 5/2009 | Brillert et al. |
| 2016/0265378 | A1 | 9/2016 | Dungs et al. |

FOREIGN PATENT DOCUMENTS

| | | | |
|---|---|---|---|
| EP | 2873807 | A1 | 5/2015 |
| GB | 1209419 | A | 10/1970 |
| GB | 2258273 | A | 2/1993 |
| WO | 2007028703 | A1 | 3/2007 |

* cited by examiner

SEALING SYSTEM AND GAS TURBINE

CROSS REFERENCE TO RELATED APPLICATIONS

This application is the US National Stage of International Application No. PCT/EP2014/072817 filed Oct. 24, 2014, and claims the benefit thereof. The International Application claims the benefit of European Application No. EP13193327 filed Nov. 18, 2013. All of the applications are incorporated by reference herein in their entirety.

FIELD OF INVENTION

The present invention relates to a bolt and to a sealing system with the bolt and with a cover plate for sealing a joint between a rotor disk and a blade root, arranged in a blade root groove of the rotor disk, of a rotor blade. The sealing arrangement is provided in particular in a gas turbine.

BACKGROUND OF INVENTION

It is known in the prior art to seal the joint between the rotor disk and the blade root by means of plate-like sealing elements. In order to axially secure such sealing plates, WO 2007/028703 A1 discloses an arrangement of rotor blades in a rotor with a shaft collar, on the outer circumference of which rotor blade retaining grooves extending in the axial direction of the rotor are provided. A projection in which a circumferential groove open radially toward the outside is provided is arranged in the region of the retaining grooves on an end side face of the shaft collar. A securing groove is associated with each rotor blade. In order to axially secure the rotor blade, a sheet-like sealing element engaging in the circumferential groove and in the securing groove is in each case provided. All sealing elements form an end sealing ring in the circumferential direction. In order to secure the sealing elements against displacement in the circumferential direction, at least one of the sealing elements comprises a metal strip fastened to the latter. The metal strip is attached to the radially inner end of the sealing element, is L-shaped, and bears against the rotor disk.

In addition, other arrangements are known in the prior art which are intended to secure the sealing plates against displacement in the circumferential direction. GB 2 258 273 A thus discloses a locking arrangement for rotor blades of an axial turbo engine in which the sealing plate has a rectangular piece which fits into a recess of the blade root in the mounted state.

U.S. Pat. No. 3,656,865 A discloses plates which are fixed by means of screws in the circumferential direction.

EP 1 944 471 A1 discloses an arrangement with a one-piece bolt, seated in a hole, which is likewise at the same time positively connected to a sealing element associated with it, wherein the bolt is in turn secured against becoming detached by a securing plate.

In U.S. Pat. No. 2,971,744 A, in order to fasten rotor blades, a washer is retained on a blade root arranged in a rotor by means of two superposed strip pins which, after passing through an open gap below the blade root, are flange-mounted between the blade root and the rotor.

U.S. Pat. No. 3,887,298 A discloses a sealing device with two sealing plates, arranged opposite each other on a rotor disk, the protrusions of which, projecting into a cavity of the rotor disk, overlap, wherein the protrusion of one sealing plate has an inclined plane, as a result of which this protrusion presses radially against the other protrusion during the rotation of the rotor disk and the sealing plate is pressed against the rotor disk.

SUMMARY OF INVENTION

An object of the present invention is to provide an improved arrangement for sealing the joint between the rotor disk and the blade root.

This object is achieved with a bolt, a sealing system, and a gas turbine. Advantageous developments of the invention are given in the dependent claims and described in the description.

The bolt according to the invention has a bolt length which extends from a bolt front side to a bolt rear side. The bolt has an upper part and a lower part, wherein the bolt is split into the upper part and the lower part over its entire bolt length. According to the invention, the bolt has a lug.

By virtue of the structure consisting of multiple parts, the bolt can have a contour with a different shape over its bolt length but can nevertheless be mounted because the parts can be placed in their assembled position one after the other. There is more space available for the part inserted first during insertion.

In its assembled position, the upper part can engage, with its lug, positively behind a cover plate. Undesired displacement of the upper part in the assembled position is thereby prevented.

In an advantageous embodiment of the bolt according to the invention, the upper part has an upper part underside and the lower part has a lower part upper side. The upper part underside is shaped so that it corresponds with the lower part upper side in such a way that the upper part and the lower part can be displaced relative to each other in the direction of the bolt length. For this purpose, the upper part and the lower part are in particular provided with a groove/spring combination.

The positioning of the lower part relative to the upper part is hence facilitated because the lower part is guided under the upper part by the corresponding contours when it is inserted. Lateral deviation is not possible. Correct positioning of the bolt parts in the desired end position is thus additionally ensured.

In a further advantageous embodiment of the bolt according to the invention, the upper part or the lower part has a depression on the bolt front side.

It is thus made possible to easily press-fit the upper part and the lower part to each other, wherein the press-fitting represents a cost-effective method step. It is thus made possible to mount the bolt simply and cost-effectively.

In an advantageous embodiment, the lower part of the bolt has an inclined face on the bolt front side.

As a result of the inclined face, it is ensured that the bolt parts can be mounted better and the lower part can be pushed more easily under the upper part.

The sealing system according to the invention for sealing a joint between a rotor disk and a blade root, arranged in a blade root groove of the rotor disk, of a rotor blade comprises a cover plate and an above described bolt. The cover plate has an upper cover plate end side for insertion into an upper groove of the rotor blade, a lower cover plate end side arranged opposite the upper cover plate end side for insertion into a lower groove of the rotor disk, a projection arranged on the upper cover plate end side for engagement in a pocket of the upper groove, and a recess arranged on the lower cover plate end side.

Circumferential securing of the cover plate is advantageously provided by the projection. The cover plate is secured against displacement simply and effectively by the projection which engages positively in the pocket of the upper groove.

The cover plate can be additionally secured to the bolt by the recess.

The covering system according to the invention with the bolt according to the invention is in particular integrated in a gas turbine.

The gas turbine thus moreover comprises a rotor disk, a rotor blade arranged in the rotor disk. The rotor blade is provided with a blade platform, a blade leaf arranged above the blade platform, and a blade root arranged below the blade platform. A protrusion is formed by the blade platform which protrudes, at a blade root end side of the rotor blade, beyond the blade root. An upper groove, which runs along the blade root end side and is open at the bottom in the direction of the space below the blade platform, is arranged in the protrusion. The upper groove has a pocket by means of which a groove width of the upper groove is enlarged along a pocket length of the pocket. The rotor disk has a circumferential surface provided with at least one blade root groove for receiving the blade root of the rotor blade, and a circumferential lower groove which is radially open to the outside and arranged in the circumferential surface. A projection with a bolt hole for receiving the bolt is arranged on the blade root groove, adjoining the lower groove. The cover plate is arranged with its upper cover plate end side in the upper groove of the rotor blade, and with its lower cover plate end side in the lower groove of the rotor disk, and with its projection in the pocket of the upper groove. The cover plate is fixed by means of the bolt arranged in the bolt hole of the rotor disk and in the recess of the cover plate. The lug of the bolt is here arranged between the cover plate and the blade root end side.

The rotor blade of the gas turbine thus has a form which corresponds to the cover plate. The projection of the cover plate projects into the pocket of the rotor blade and displacement of the cover plate in the circumferential direction is prevented.

The bolt hole in the rotor disk offers the possibility of positioning the bolt and the cover plate is additionally secured against undesired displacement in the circumferential direction. In addition, a more stable seating of the cover plate is achieved by the mounting of the bolt, as a result of which the sealing is improved too.

The gas turbine thus benefits from the advantages of the individual components. By means of the sealing system according to the invention, a gas turbine with securely and stably seated cover plates is provided.

BRIEF DESCRIPTION OF THE DRAWINGS

Exemplary embodiments of the invention are explained in detail with the aid of the following description and the drawings, in which.

DETAILED DESCRIPTION OF INVENTION

Figure 1:
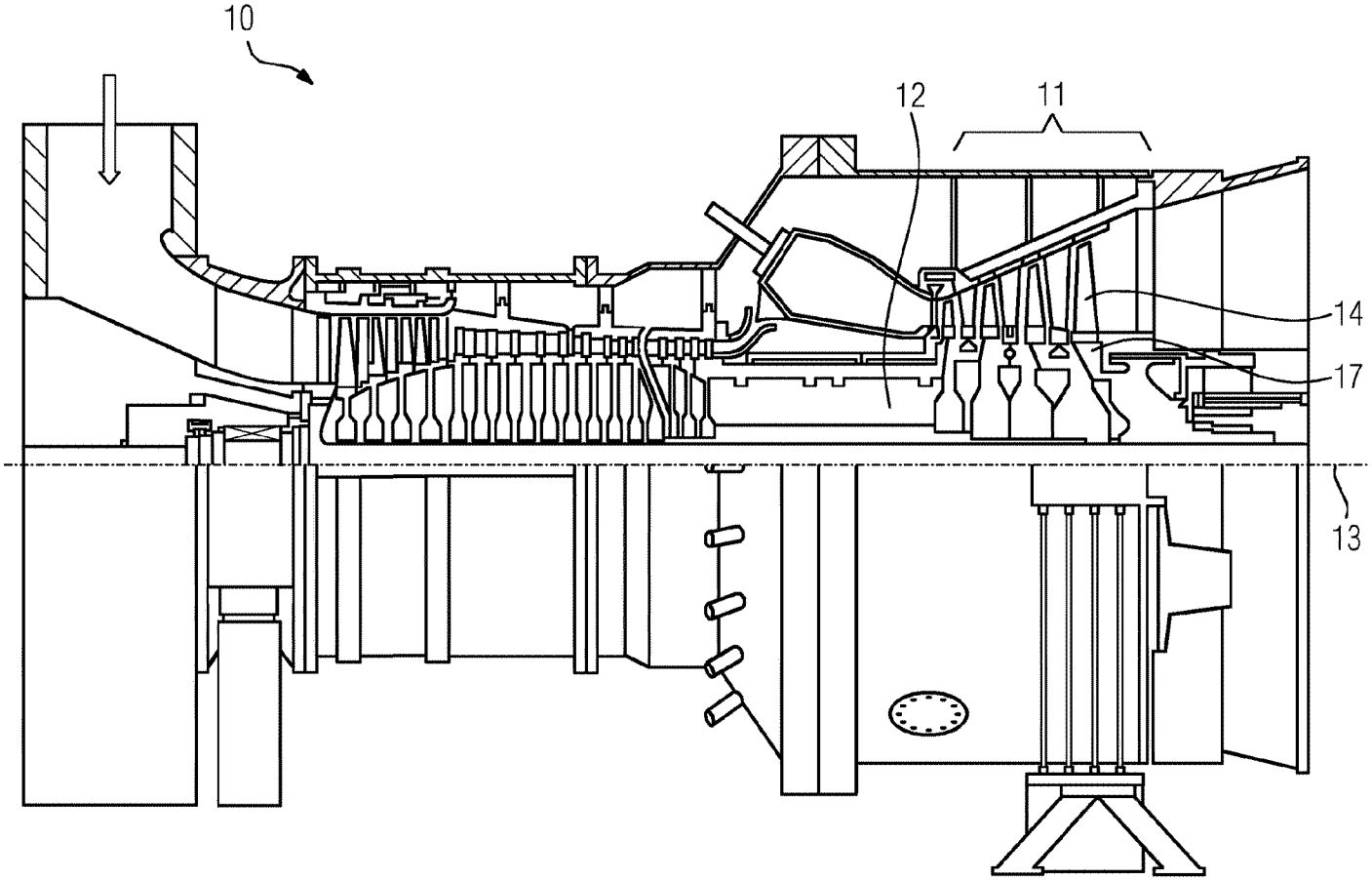
FIG. 1 shows a gas turbine according to the invention.

A gas turbine 10 according to the invention is illustrated in FIG. 1 in an exemplary embodiment. The gas turbine 10 shown comprises a turbine 11 in which at least one row of rotor blades with multiple rotor blades 14 is arranged. The turbine 11 shown has four rows of rotor blades. The rotor blades 14 are part of a rotor 12 which is arranged rotatably about an axis of rotation 13. The rotor blades 14 are fastened to a rotor disk 17.

Figure 2:
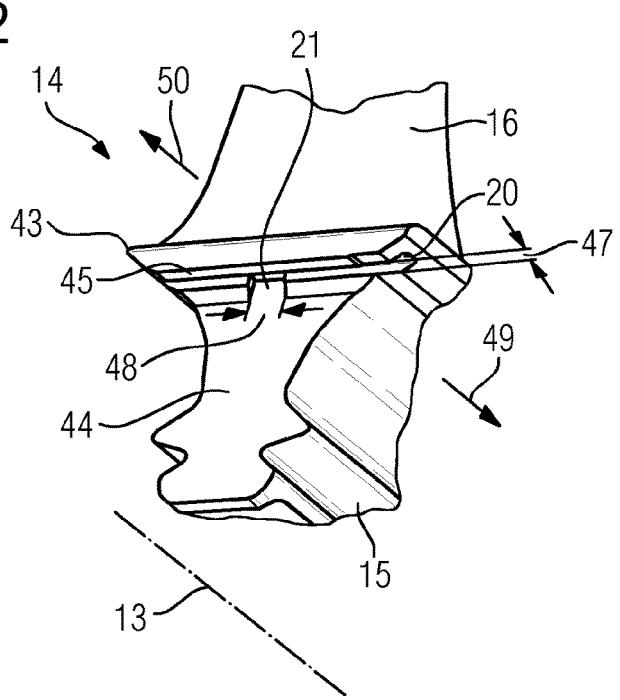
FIG. 2 shows a rotor blade of the gas turbine.

A rotor blade 14 of the gas turbine 10 is illustrated in FIG. 2 in an exemplary embodiment. The rotor blade 14 comprises a blade platform 43, a blade leaf 16, and a blade root 15. The blade leaf 16 is here arranged above the blade platform 43, and the blade root 15 is here arranged below the blade platform 43. The blade leaf 16 and the blade root 15 are fastened to the blade platform 43. The blade leaf 16 and the blade platform 43 and the blade root 15 are together formed in particular as a monolithic body.

The blade platform 43 protrudes on a blade root end side 44 beyond the blade root 15. As a result, a protrusion 45 is formed. The rotor blade 14 has an upper groove 20 in this protrusion 45. The upper groove 20 runs essentially parallel to the blade root end side 44. The upper groove 20 has a groove width 47 and is open at the bottom. The upper groove 20 is open in the direction of the space below the blade platform 43. In the mounted state, the upper groove 20 is open radially, in the direction of the axis of rotation 13. The upper groove 20 is closed above, in the direction of the space above the blade platform 43, and to the rear 49 and the front 50. In the mounted state of all the rotor blades 14 in the rotor disk 17, the upper groove 20 is designed so that it is radially circumferential. In the regions between the individual rotor blades 14, the circumferential upper groove 20 may be formed by the rotor disk 17. In the mounted state, the groove width 47 runs lengthwise with respect to the axis of rotation 13. The upper groove 20 has in particular an essentially rectangular cross-section.

The directions to the front 50 and to the rear 49 run lengthwise with respect to the axis of rotation 13 in the mounted state. In the assembled state in the gas turbine 10, to the rear 49 corresponds to downstream, and to the front 50 corresponds to upstream.

The rotor blade 14 has a pocket 21 in the upper groove 20. The pocket is in particular formed in the center of the blade root end side 44. The pocket 21 can be formed to the rear 49 (cold air side) or to the front 50 (hot gas side).

In the embodiment shown, the pocket is formed to the rear 49. The pocket 21 has a specific pocket length 48. The pocket length 48 is designed parallel to the upper groove 20. The upper groove 20 has an increased groove width 47 in the region of the pocket 21.

Figure 3:
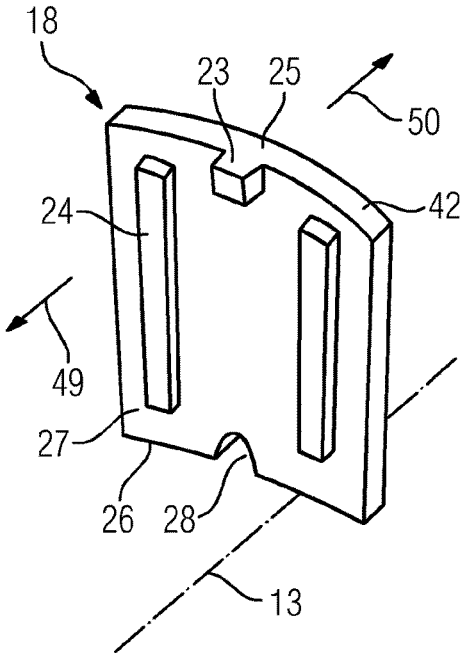
FIG. 3 shows a cover plate of the gas turbine.

A cover plate 18 of the gas turbine 10 is illustrated in FIG. 3 in an exemplary embodiment. The cover plate 18 is in particular a metal plate. The cover plate 18 serves to seal a joint between the rotor disk 17 and the blade root 15.

The cover plate 18 has an upper cover plate end side 25 and a lower cover plate end side 26, arranged opposite the upper cover plate end side 25. The upper cover plate end side 25 is designed for insertion into the upper groove 20 of the rotor blade 14, and the lower cover plate end side 26 is designed for insertion into a lower groove 41 of the rotor disk 17.

The cover plate 18 has a projection 23 on the upper cover plate end side 25. The projection 23 has a form which corresponds to the form of the pocket 21. The projection 23 and the pocket 21 are designed in such a way that the pocket 21 can receive the projection 23. The pocket 21 has essentially a negative form of the projection 23. In the embodiment shown, the projection 23 is formed in the direction of a cover plate rear side 27, corresponding to the embodiment of the pocket 21 of the upper groove 20, which is formed according to FIG. 2 to the rear 49. The pocket 21 can likewise be formed to the front 50, and the projection 23 is then formed correspondingly in the direction of a cover plate front side 42.

The cover plate 18 shown has strengthening ribs 24 on the cover plate rear side 27 in order to increase the rigidity of the cover plate 18. In addition, the cover plate 18 shown has a recess 28 on the lower cover plate end side 26.

As a result of this recess 28, the cover plate 18 can be fixed in its assembled location by means of a bolt 19 according to the invention.

Figure 4:
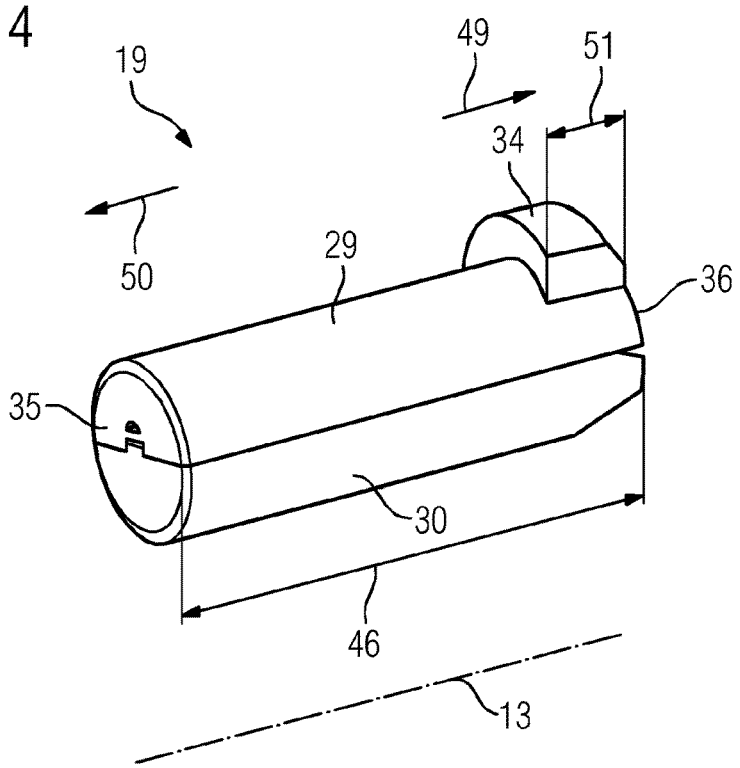
FIG. 4 shows a bolt according to the invention.
Figure 5:
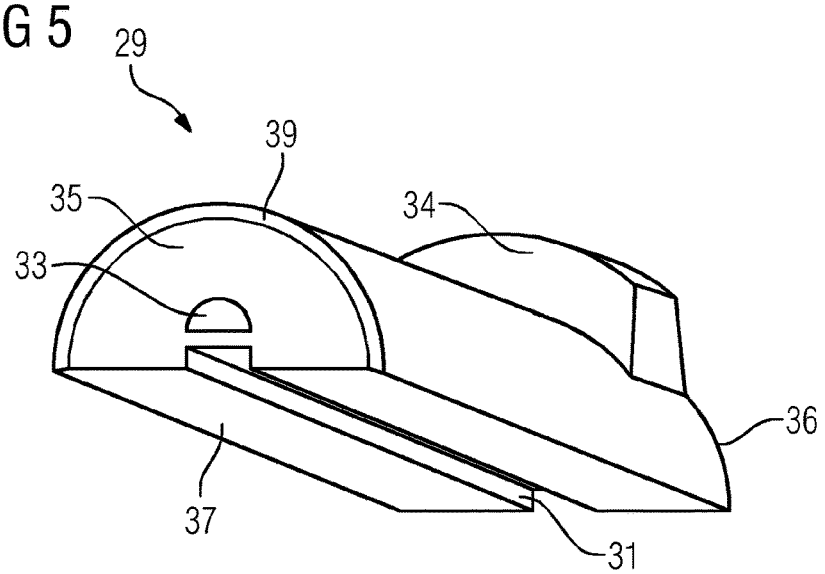
FIG. 5 shows an upper part of the bolt according to the invention.
Figure 6:
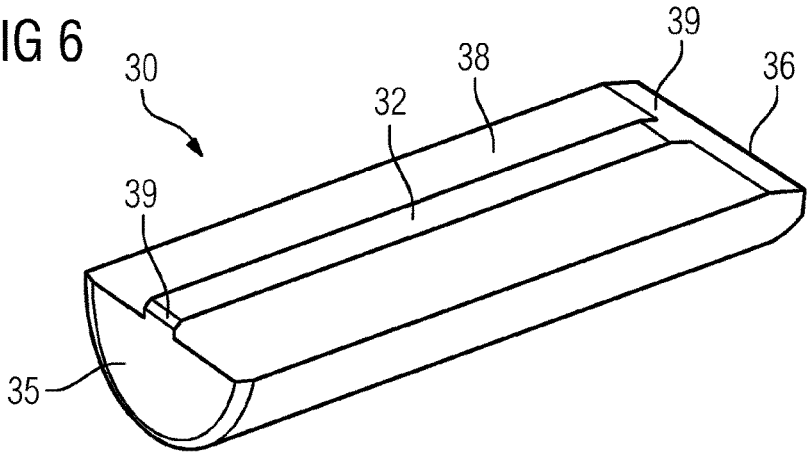
FIG. 6 shows a lower part of the bolt according to the invention.

The bolt 19 according to the invention is illustrated in FIG. 4 in an exemplary embodiment. An upper part 29 of the bolt 19 according to the invention is shown in detail in FIG. 5 and a lower part 30 in FIG. 6, in each case in an exemplary embodiment.

The bolt 19 has a bolt front side 35 and a bolt rear side 36. A bolt length 46 extends from the bolt front side 35 to the bolt rear side 36.

The bolt 19 consists according to the invention of multiple parts 29, 30. The bolt 19 comprises the upper part 29 and the lower part 30. Thus both the upper part 29 and the lower part 30 have the bolt length 46. The upper part 29 and the lower part 30 split the bolt 19 shown into two parts over the whole bolt length 46. The upper part 29 and the lower part 30 are thus arranged relative to each other in the mounted state in such a way that the upper part 29 bears with an upper part underside 37 on a lower part upper side 38 of the lower part 30. The upper part underside 37 is in particular shaped to correspond with the lower part upper side 38 in such a way that the upper part 29 and the lower part 30 can be displaced relative to each other in the direction of the bolt length 46. This is achieved in particular by a groove/spring combination. In the case of the bolt 19 shown, the upper part 29 is provided with a bolt groove 31 according to FIG. 5, and the lower part 30 is provided with a bolt spring 32 according to FIG. 6. According to the invention, other contours of the upper part underside 37 and the lower part upper side 38 are also conceivable which are formed in the same fashion along the bolt length 46 in order to be able to ensure displaceability along the bolt length 46.

In the embodiment of the bolt 19 shown, the upper part has a lug 34. The lug 34 projects from the cylindrical contour of the bolt 19. The lug 34 forms in particular a part of the bolt rear side 36. The lug 34 has a lug length 51. The lug length 51 runs lengthwise relative to the bolt length 46. In particular, the lug length 51 is less than half the bolt length 46.

In order to press-fit the two bolt parts 29, 30 together in the mounted position of the bolt 19, the upper part 29 shown has a depression 33 on the bolt front side 35. It is also conceivable that the depression 33 is arranged on the lower part 30. By means of local plastic projection, a positive connection can be created by press-fitting between the two parts 29, 30 along the bolt length 46.

In the embodiment shown, the upper part 29 and the lower part have multiple inclined faces 39. The inclined faces 39 serve to improve the ability to mount the bolt parts 29, 30. The lower part 30 which is to be pushed under the upper part 29 thus has an inclined face 39 on the bolt front side 36. An inclined face 39 at the rear end of the bolt spring 32 serves to receive the material of the upper part 29 which is deformed during press-fitting.

Figure 7:
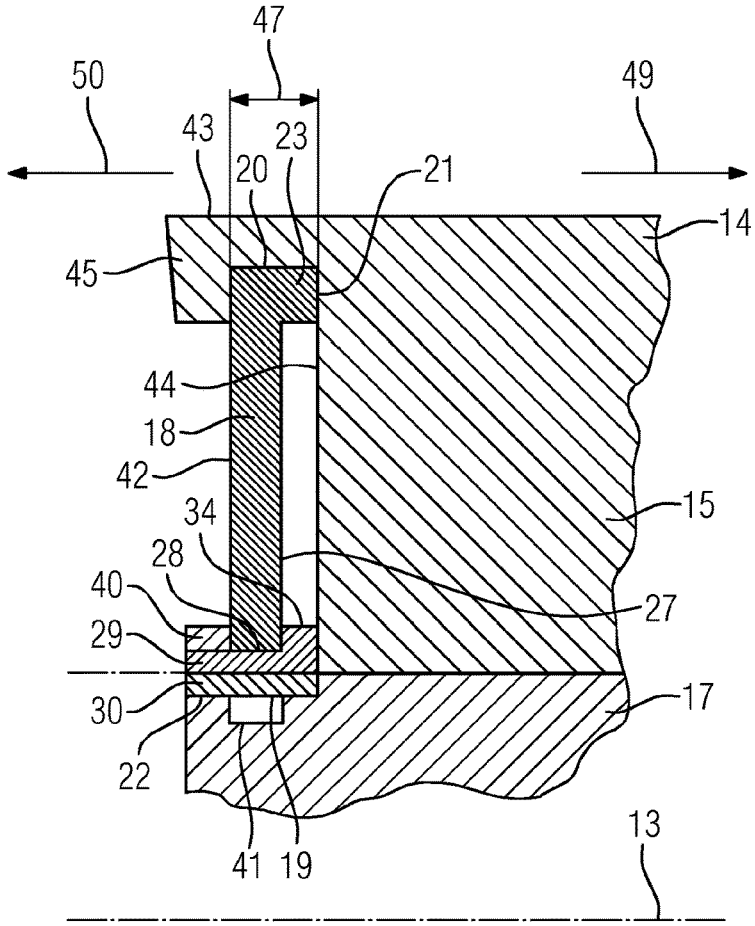
FIG. 7 shows an assembled situation.

An assembled position is illustrated in an exemplary embodiment in FIG. 7. The rotor disk 17, the rotor blade 14, the cover plate 18, and the bolt 19 are shown in the mounted state in a cross-sectional view. The cross-section here runs lengthwise with respect to the axis of rotation 13 over the width of the pocket 21 of the upper groove 20.

The rotor disk 17 has a circumferential surface in which multiple blade root grooves for receiving the blade roots 15 of the rotor blades 14 are provided. The rotor disk 17 has one blade root groove per rotor blade 14. The blade root grooves are thus, as is common in the prior art, introduced in the circumferential surface essentially transversely to the circumferential direction of the rotor disk 17. In order to mount the rotor blade 14 on the rotor disk 17, the blade root 15 with the blade root end side 44 is pushed into the blade root groove. In the mounted state of the rotor blade 14, the blade platform upper side is preferably flush with the circumferential surface of the rotor disk 17.

The lower groove 41 is arranged in the circumferential surface of the rotor disk 17. The lower groove 41 is designed to be circumferential and open radially outwards. The direction radially outwards here means directed away from the center point of the rotor disk 17. In the mounted state, the lower groove 41 is arranged opposite the upper groove 20. The open sides of the lower groove 41 and the upper groove 20 face each other.

The rotor disk 17 has, at least on one of the blade root grooves, adjoining the lower groove 41, a projection 40 which is provided with a bolt hole 22.

The bolt hole 22 serves to receive the bolt 19 according to the invention in order to fix the cover plate 18 in its assembled position. To do this, the cover plate 18 is first brought into its end position and then the upper part 29 of the bolt 19 is passed through the bolt hole 22 of the rotor disk 17 and through the recess 28 of the cover plate 18 so that the lug 34 engages behind the cover plate 18. The lug 34 fills the space between the cover plate rear side 27 and the blade root end side 44 lengthwise with respect to the bolt length 46. After the upper part 29, the lower part 20 is pushed under the upper part 29 through the bolt hole 22 of the rotor disk 17 and through the recess 28 of the cover plate 18. The groove/spring combination of the bolt 19 here helps to position the upper part 29 and the lower part 30 relative to each other. The bolt parts 29, 30 are then fixed, in particular by press-fitting. The bolt 19 is fastened positively. The upper part 29 is fastened positively to the front 50 by the lug 34. The lower part 30 is fastened positively to the front 50 by the press-fitting. The positive connection is produced in the other directions by the blade root 15 and the rotor disk 17.

In the assembled state, all the cover plates 18, lined up one after the other, form a sealing band. It is possible that the cover plates 18 have overlapping regions (not shown here) on their sides, as a result of which the sealing effect between the cover plates 18 is increased because there is no straight continuous joint between two cover plates 18.

Although the invention has been described and illustrated in detail by the preferred exemplary embodiment, the invention is not limited by the disclosed examples, and other variants can be derived by a person skilled in the art without going beyond the scope of the invention.

The invention claimed is:

1. A sealing system for sealing a joint between a rotor disk and a blade root, arranged in a blade root groove of the rotor disk, of a rotor blade, wherein the sealing system comprises:

a cover plate and a bolt, wherein the cover plate has an upper cover plate end side for insertion into an upper groove of the rotor blade, and a lower cover plate end side arranged opposite the upper cover plate end side for insertion into a lower groove of the rotor disk, and a projection arranged on the upper cover plate end side for engagement in a pocket of the upper groove and a recess arranged on the lower cover plate end side, wherein the bolt has a bolt length which extends from a bolt front side to a bolt rear side, wherein the bolt has an upper part and a lower part, wherein the bolt is split into the upper part and the lower part over its entire bolt length, wherein the upper part has a lug.

2. The sealing system as claimed in claim 1, wherein the upper part has an upper part underside and the lower part has a lower part upper side, wherein the upper part underside is shaped so that it corresponds with the lower part upper side in such a way that the upper part and the lower part can be displaced relative to each other in the direction of the bolt length.

3. The sealing system as claimed in claim 2, wherein one of the upper part or the lower part has a bolt groove running lengthwise with respect to the bolt length, and the other part of the upper part or the lower part has a bolt spring.

4. The sealing system as claimed in claim 1, wherein the upper part or the lower part has a depression on the bolt front side.

5. The sealing system as claimed in claim 1, wherein the lower part has an inclined face on the bolt front side.

6. A gas turbine, comprising:

a rotor disk, a rotor blade arranged in the rotor disk, and a sealing system as claimed in claim 1, wherein the rotor blade is provided with a blade platform, a blade leaf arranged above the blade platform, and a blade root arranged below the blade platform, wherein a protrusion is formed by the blade platform which protrudes, at a blade root end side of the rotor blade, beyond the blade root, and an upper groove, which runs along the blade root end side and is open at the bottom in the direction of the space below the blade platform, is arranged in the protrusion, wherein the upper groove has a pocket by means of which a groove width of the upper groove is enlarged along a pocket length of the pocket, wherein the rotor disk has a circumferential surface provided with at least one blade root groove for receiving the blade root of the rotor blade, and a circumferential lower groove which is open radially to the outside and arranged in the circumferential surface, and a projection with a bolt hole for receiving the bolt is arranged on the blade root groove, adjoining the lower groove, wherein the cover plate is arranged with its upper cover plate end side in the upper groove of the rotor blade, and with its lower cover plate end side in the lower groove of the rotor disk, and with its projection in the pocket of the upper groove, and wherein the cover plate is fixed by means of the bolt arranged in the bolt hole of the rotor disk and in the recess of the cover plate, wherein the lug of the bolt is arranged between the cover plate and the blade root end side.

* * * * *